US007174902B2

(12) United States Patent
Rizzuto

(10) Patent No.: US 7,174,902 B2
(45) Date of Patent: Feb. 13, 2007

(54) HAIR ORNAMENT WITH A RESILIENT ATTACHING CLIP

(75) Inventor: Leandro P. Rizzuto, Greenwich, CT (US)

(73) Assignee: Conair Corporation, Stamford, CT (US)

( * ) Notice: Subject to any disclaimer, the term of this patent is extended or adjusted under 35 U.S.C. 154(b) by 336 days.

(21) Appl. No.: 10/466,410

(22) PCT Filed: Jan. 26, 2001

(86) PCT No.: PCT/IB01/00109

§ 371 (c)(1),
(2), (4) Date: Jul. 14, 2003

(87) PCT Pub. No.: WO02/058504

PCT Pub. Date: Aug. 1, 2002

(65) Prior Publication Data

US 2004/0025898 A1 Feb. 12, 2004

(51) Int. Cl.
*A45D 8/20* (2006.01)
*A45D 8/12* (2006.01)

(52) U.S. Cl. ..... 132/277

(58) Field of Classification Search ..... 132/275–279; 24/499–501, 509–510
See application file for complete search history.

(56) References Cited

U.S. PATENT DOCUMENTS 5,494,060 A 2/1996 Potut
5,842,482 A * 12/1998 Potut ..... 132/277
5,873,377 A * 2/1999 Yang ..... 132/277
5,979,467 A * 11/1999 Potut et al. ..... 132/277
6,082,371 A 7/2000 Bader-Saltzman et al.
6,354,307 B1 * 3/2002 Potut ..... 132/277
6,357,452 B2 * 3/2002 Bolito ..... 132/277

FOREIGN PATENT DOCUMENTS

EP 1353579 8/2002

* cited by examiner

*Primary Examiner*—Kevin Shaver
*Assistant Examiner*—Stephanie Willatt
(74) *Attorney, Agent, or Firm*—Lawrence Cruz; Steven A. Garner

(57) ABSTRACT

Hair ornament with a resilient attaching clip comprising a pair of complementary transversally elongated limbs (12, 14) having handle portions (30, 32) and which are connected by hinge and spring means (16) and having suitably shaped prongs (18) extending from each elongated limbs (12, 14) and forming a pair of clipping portions wherein each elongated limb comprises a socket (20, 22) having a hollow cylindrical recess and which forms at the inner opposite end abutting sliding planes (23, 25), as well as a bushing (24) which is received in a recess provided in the respective socket of each limb, whereby the limbs are pivoted to each other and a spring (26) inserted in the bushing extending into the sockets and being attached at both ends by suitable means at the outer end of the sockets in order to bias the limbs in the closed position.

3 Claims, 1 Drawing Sheet

HAIR ORNAMENT WITH A RESILIENT ATTACHING CLIP

FIELD OF THE PRESENT INVENTION

The invention relates to a hair ornament and particularly to a device having an esthetical aspect, i.e. a highly ornamental appearance and comprising novel means combined therewith for attaching it to the hair of the wearer.

An important object of the invention is to provide such a device wherein the means for attaching the device to the hair is in the form of a clip positioned by a hinge and spring means which remain wholly hidden from view when the ornament is borne in the hair, and which can be firmly clamped in the hair.

BACKGROUND AND PRIOR ART OF THE PRESENT INVENTION

Devices intended to be used as an ornament and comprising a resilient attaching clip have been widely used.

They comprise a spring mean intended to clip two parts or limbs connected by a hinge for securing the device to the hair of the wearer.

Such hinge and sometimes the spring are externally visible and sometimes hair remains entangled with the hinge mechanism.

Obviously, the visibility of the hinge and spring and, of course, the possibility of entaglement with the hair are undesirable features, which the device of the invention seeks to avoid.

Other objects and advantages of the invention will become apparent during the course of the following description.

BRIEF DESCRIPTION OF THE DRAWINGS

In the drawings, the same numerals are used for identical parts for all the Figures.

DESCRIPTION OF A PREFERRED EMBODIMENT OF THE INVENTION

Figure 1:
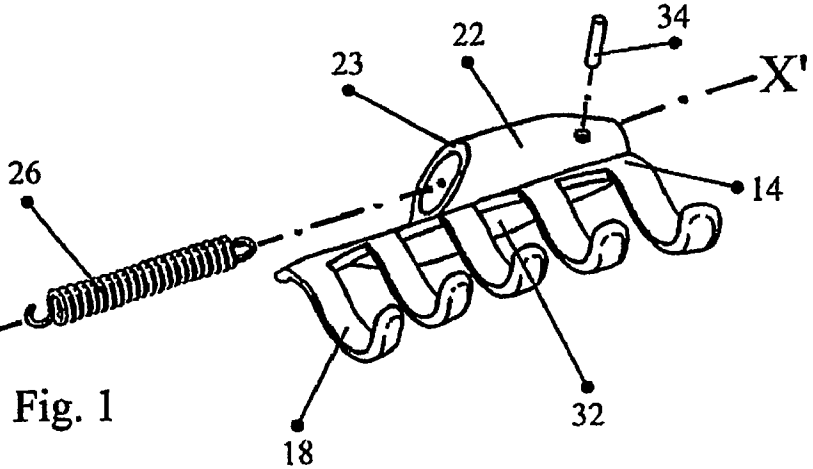
FIG. 1 is an exploded view of the main parts of the device according to the invention

Referring to the drawings, the numeral 10 designates the body of the device shown in the present instance as comprising a pair of complementary transversally elongated limbs 12 and 14, which are connected by hinge and spring means 16 and having suitably shaped prongs 18 extending from each elongated limbs 12 and 14. The prongs 18 form a pair of clipping portions or jaws allowing, when they are in the closed position, to maintain the device in the hair of the bearer.

Each elongated limb 12 and 14 comprises a socket 20 and 22 (represented as substantially cylindrical shaped), having a hollow cylindrical recess which is preferably closed at the outer end thereof and which forms at the inner opposite end to the outer end, abutting sliding planes 23 and 25 which can be, as represented, inclined at en angle of 45° approximately in respect of the common axis X–X' of the elongated sockets 20 and 22 or which can fit directly to each other, this corresponding to a perpendicular position to the X—X axis.

The socket 20, as represented for one limb 12 extends over one half of the length of said limb and the socket 22 for the second limb 14 also extends over one half of the length of the corresponding limb.

A bushing 24 may be received in the recesses of the sockets 20 and 22 and a spring 26 is in turn located in the bushing 24.

The limbs 12 and 14 are thus pivoted to each other by means of said bushing 24. Furthermore, the spring 26 located in the bushing 24 extends into the sockets 20 and 22 and is attached at both ends by suitable means, such as the pins or plugs 34 at the outer end of the sockets 20 and 22 so as to bias the limbs 12 and 14 in the closed position.

The spring 26, as shown at both ends comprises hook parts allowing the mounting of the device in the closed position with the pins 34 securing the spring in a permanent traction bias to clip into the hair. When the lugs 30, 32 are pressed, the rotation of the limbs 12 and 14 twist the spring. When these lugs are no longer pressed, the limbs revert to the closing (gripping) position.

Figure 4:
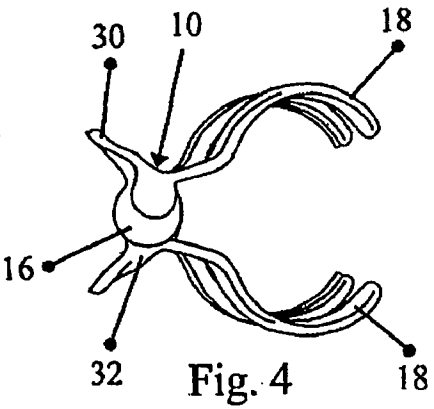
FIG. 4 is a view corresponding to FIG. 2 but in an open position
Figure 3:
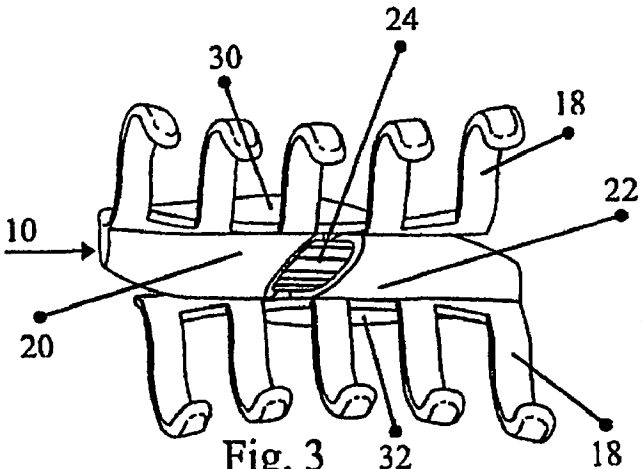
FIG. 3 is a further perspective face view of the device in open position.
Figure 2:
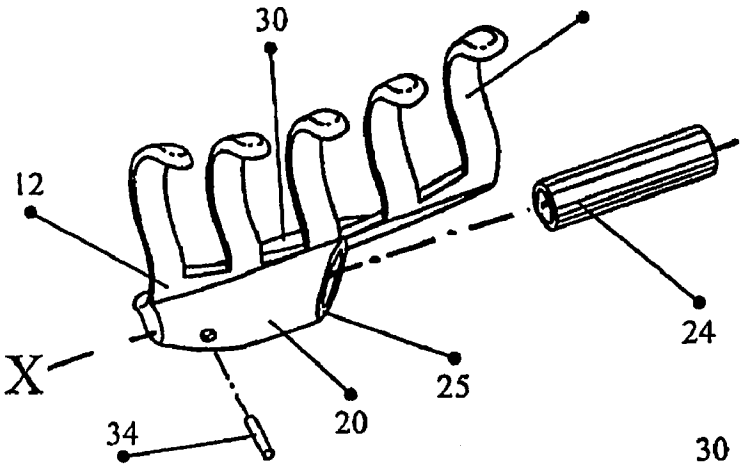
FIG. 2 is a side perspective view of the device in closed position.
Figure 2:
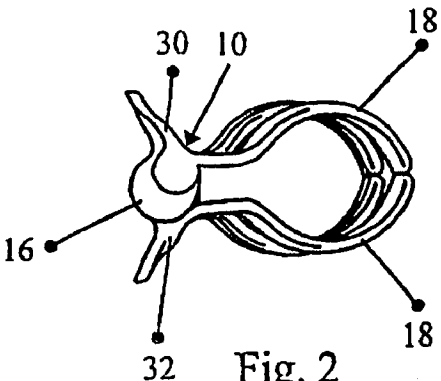

Handle portions 30 and 32 in the form of lugs allow to open the device starting from an abutment position (such as represented in FIG. 2) to an open position (as in FIGS. 3 and 4).

Although in FIG. 1, the bushing is represented as a separate part, said bushing could be solid with e.g. the socket 20, i.e. be part of the socket but having an outer smaller diameter in order to allow it to be received into the socket 22.

In FIG. 2, the contact of the prongs 18 of each limb 12 and 14 causes the abutment position.

The prongs 18 could however be offset for the first limb 12 compared to the prongs 18 for the second limb 14 and abutment parts may then be provided at suitable positions on the limbs proper in the closed position.

The sliding planes 23, 25 will cause the limbs 12 and 14 when the lugs 30, 32 are pressed by the fingers of the user against the biasing due to the spring 26 to move from the position of FIG. 2 toward the position of FIGS. 3 and 4. In the case where the limbs presents inclined sliding planes in a particular angle different of 90° to the X—X axis, it also "stretches out" the limb 12 of the device from the limb 14, thus extending the spring 26.

As soon as the pressing action is released, under the action of the spring 26, a sliding of the two planes 23, 25 of the sockets 20 and 22 will cause the device to revert to its initial closed position.

As seen from the outside (rear) of the device, the two sliding planes appear as line, thus forming a hidden hinge in all the positions of the device (open or closed). Furthermore, the spring 26 also remains hidden from the view, be it for the outside or the inside, only the bushing 24 being visible from the inside in the case of inclined planes 23 and 24.

The number of prongs and their position as well as a their shape can of course be adapted to the intended specific use and are not necessarily as shown on the drawings.

The device of the invention can be made of any material such as metal or plastic or combination thereof.

The finger grasping portion (i.e. the lugs 30, 32) can also have various dimensions and sizes, provided they can be used properly as handles.

It should be noted that the spring 26 may also be fixed by the pins 34, in the closed position of the device not only as being biased under traction but also as being twisted in such a manner that the opening movement under the pressure on the lugs 30 and 32 will cause it to be twisted even more. In such case the planes 23 and 25 may have an inclination different from what is shown and may even be perpendicular to the said axis X–X'.

It is to be understood that the form of the invention shown and described is to be taken as a preferred example of the same and that various changes in the shape, size and arrangement of the parts may be made, without departing from the scope of the claims.

The invention claimed is:

1. Hair ornament with a resilient attaching clip comprising a pair of complementary transversally elongated limbs (12 & 14) having handle portions and which are connected by a hinge and spring assembly (16) and having prongs (18) extending from each elongated limb (12 & 14) and forming a pair of clipping portions wherein each elongated limb comprises a socket having a hollow cylindrical recess and which forms at the inner opposite end abutting sliding planes (23 & 25), as well as a bushing which is received in a recess provided in the respective socket of each limb, whereby the limbs are pivoted with respect to each other, and a spring inserted in the bushing, extending into the sockets and being attached at both ends at the outer end of the sockets in order to bias the limbs in a closed position.

2. Hair ornament according to claim 1, wherein the said sliding planes have inclinations between 45 and 90 degrees at an angle in respect of a common axis of the said sockets.

3. Hair ornament according to claim 1, wherein the said prongs are in an abutment position when the hair ornament is in the closed position.

* * * * *